US008221137B2

(12) United States Patent
Zheng et al.

(10) Patent No.: US 8,221,137 B2
(45) Date of Patent: Jul. 17, 2012

(54) MINI DISPLAY PORT STRUCTURE

(75) Inventors: Jia-Mao Zheng, ShenZhen (TW); Hong-Guang Kuang, ShenZhen (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 13/030,750

(22) Filed: Feb. 18, 2011

(65) Prior Publication Data

US 2012/0071012 A1 Mar. 22, 2012

(30) Foreign Application Priority Data

Sep. 16, 2010 (TW) ..... 99217978 U

(51) Int. Cl.
*H01R 12/00* (2006.01)

(52) U.S. Cl. ..... 439/80

(58) Field of Classification Search ..... 439/78–80, 439/76.1, 492, 951, 630, 82–84
See application file for complete search history.

(56) References Cited

U.S. PATENT DOCUMENTS

| | | | | |
|---|---|---|---|---|
| 7,104,809 | B1 * | 9/2006 | Huang | 439/76.1 |
| 7,182,610 | B2 * | 2/2007 | Lin | 439/79 |
| 2010/0045581 | A1 * | 2/2010 | Yeon | 345/87 |
| 2010/0225306 | A1 * | 9/2010 | Slaton | 324/149 |

* cited by examiner

*Primary Examiner* — Jean F Duverne
(74) *Attorney, Agent, or Firm* — The Webb Law Firm

(57) ABSTRACT

A mini display port structure is provided for receiving a connector insert. The mini display port structure includes a circuit board unit and a receptacle unit. The circuit board unit has a base board, wherein an opening is formed on one side of the base board. A portion of the receptacle unit is accommodated in the opening of the circuit board unit and is connected to the base board. Accordingly, the circuit board unit is elevated at a certain position within the height of receptacle unit, and thus the height of the receptacle unit can include the height of the circuit board unit at the same time, thereby shrinking the height of the mini display port structure after the circuit board unit is assembled for making a compact mini display port.

8 Claims, 5 Drawing Sheets

MINI DISPLAY PORT STRUCTURE

RELATED APPLICATIONS

This application claims priority to Taiwan Application Serial Number 099217978, filed Sep. 16, 2010, which is herein incorporated by reference.

BACKGROUND

1. Field of Invention

The present invention relates to a receptacle structure. More particularly, the present invention relates to a mini display port structure.

2. Description of Related Art

A mini display port is a transmission interface of audio and video signals is for connecting to a display apparatus such as a display, a projector, etc. The mini display port has the operation advantages of high quality and wide band, and thus is popularly used.

A typical mini display port includes a circuit board unit and a receptacle unit. The receptacle unit is electrically connected to the circuit board unit and has a slot for receiving a connector insert.

In the conventional mini displayport, the receptacle unit is disposed on one side of the circuit board unit, i.e. the whole receptacle unit is located on one side such as a top surface of the circuit board unit and protrudes towards one single direction, and thus the assembled height is the height of the receptacle unit plus that of the circuit board unit. Since the assembled height cannot be accommodated within a limited allowable height, the product related to the mini display port product cannot be made compact.

In view of the foregoing reasons, the conventional mini display port has poor applicability.

SUMMARY

An object of the present invention is to provide a mini display port structure which can shrink the height of the assembled mini display port for making a compact mini displayport.

According to the aforementioned object, an aspect of the present invention is to provide a mini display port structure for receiving a connector insert. The mini display port structure includes a circuit board unit and a receptacle unit. The circuit board unit has a base board, wherein an opening is formed on one side of the base board. A portion of the receptacle unit is accommodated in the opening of the circuit board unit and is connected to the base board. Accordingly, the circuit board unit is elevated at a certain position within the height of receptacle unit, and thus the height of the receptacle unit can include the height of the circuit board unit at the same time, thereby shrinking the height of the mini display port structure after the circuit board unit is assembled for making a compact mini displayport.

In one embodiment, the receptacle unit includes a plastic holder, a terminal set and an outer shell. The terminal set is assembled inside the plastic holder, and the outer shell is assembled around the plastic holder and shields the plastic holder, thereby constructing the receptacle unit.

In one embodiment, the plastic holder has a holder body, and a plurality of first terminal slots and a plurality of second terminal slots are formed on a top surface and a bottom surface of the holder body respectively. The terminal set includes a first terminal block and a second terminal block, wherein the first terminal block has a plurality of first terminals inserted into the first terminal slots of the plastic holder, the second terminal block having a plurality of second terminals inserted into the second terminal slots of the plastic holder, thereby completing the assembly between the terminal set and the plastic holder.

In one embodiment, each of the first terminals and the second terminals has an external end portion protruding out of the plastic holder, wherein the external end portion of each of the first terminals is perpendicular to the base board, and a plurality of combination holes are formed on respective positions of the base board corresponding in number and position to the external end portions of the first terminals, and the external end portions of the second terminals are parallel to the base board. Accordingly, the first terminals and the second terminals are combined with the base board of the circuit board unit by using a dual in-line package (DIP) technology and a surface mount technology (SMT).

In one embodiment, the first terminal block is molded with at least one first retainer, and the first terminals are inserted and retained at equal intervals in the first retainer. The second terminal block is molded with at least one second retainer, and the second terminals are inserted and retained at equal intervals in the second retainer.

In one embodiment, a receiving groove is disposed on each of both sides of the second retainer, and an inserting pillar is disposed on each of both sides of the first retainer corresponding in position to the receiving groove. The inserting pillar is inserted into the receiving groove for maintaining and stabilizing the distance and position between the first terminal block and the second terminal block.

In one embodiment, the terminal set further comprises a cover which receives the external end portions of the first terminals and the external end portions of the second terminals for shielding the first terminals and the second terminals.

In one embodiment, the top surface and both sides of the holder body of the plastic holder have a top platform and two sidewalls, and a clip is formed on an inner edge of each of the sidewalls, and a hook is disposed on each of both sides of the cover corresponding in position to the clip, and the hook is clipped with the clip for combining and fastening the cover and the plastic holder.

In one embodiment, a first positioning pillar is disposed on top of each of the sidewalls of the plastic holder, and a first positioning hole is formed on the base board corresponding in position to the first positioning pillar of each of the sidewalls, and the first positioning pillar is engaged with the first positioning hole for combining and fastening the plastic holder and the base board of the circuit board unit.

In one embodiment, the outer shell includes a frame-type shell and an extensive trough connected to each other, wherein the extensive trough has a bottom plate and two lateral walls connected to both sides of the bottom plate. Each of the lateral walls has a slanted protrusive plate, and each of the two sidewalls of the plastic holder has an engaging groove corresponding in position to the slanted protrusive plate, and the two lateral walls of the extensive trough envelop the two sidewalls of the plastic holder with the slanted protrusive plate engaged with the engaging groove, thereby assembling and fastening the outer shell and the plastic holder.

In one embodiment, at least one second positioning pillar is disposed on top of each of the lateral walls of the outer shell, and at least one second positioning hole corresponding in number and position to the second positioning pillar is formed on the base board, and the second positioning pillar is engaged with the second positioning hole for combining and fastening the outer shell and the circuit board unit.

In one embodiment, there is a shell wall surrounding the frame-type shell of the outer shell, and at least one elastic clip is disposed on the shell wall for clamping the connector insert, thereby providing the stability of the connector insert engaged with the frame-type shell.

In one embodiment, the mini display port structure further includes at least one elastic grounding member contacting the frame-type shell of the outer shell for grounding use.

In one embodiment, the elastic grounding member includes an inverted-U-shaped plate, wherein the inverted-U-shaped plate envelops the shell wall of the frame-type shell of the outer shell, and a top surface and both side surfaces of the inverted-U-shaped plate each has an inserting plate. An inserting groove is formed between each of the top platform and the two sidewalls of plastic holder and the holder body, and the elastic grounding member is engaged with the plastic holder by inserting the inserting plate into the inserting groove and maintaining the contact with the frame-type shell.

In one embodiment, at least one elastic arm is disposed on an end surface of the inverted-U-shaped plate opposite to the inserting plate for providing an elastic contact when the connector insert is received.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
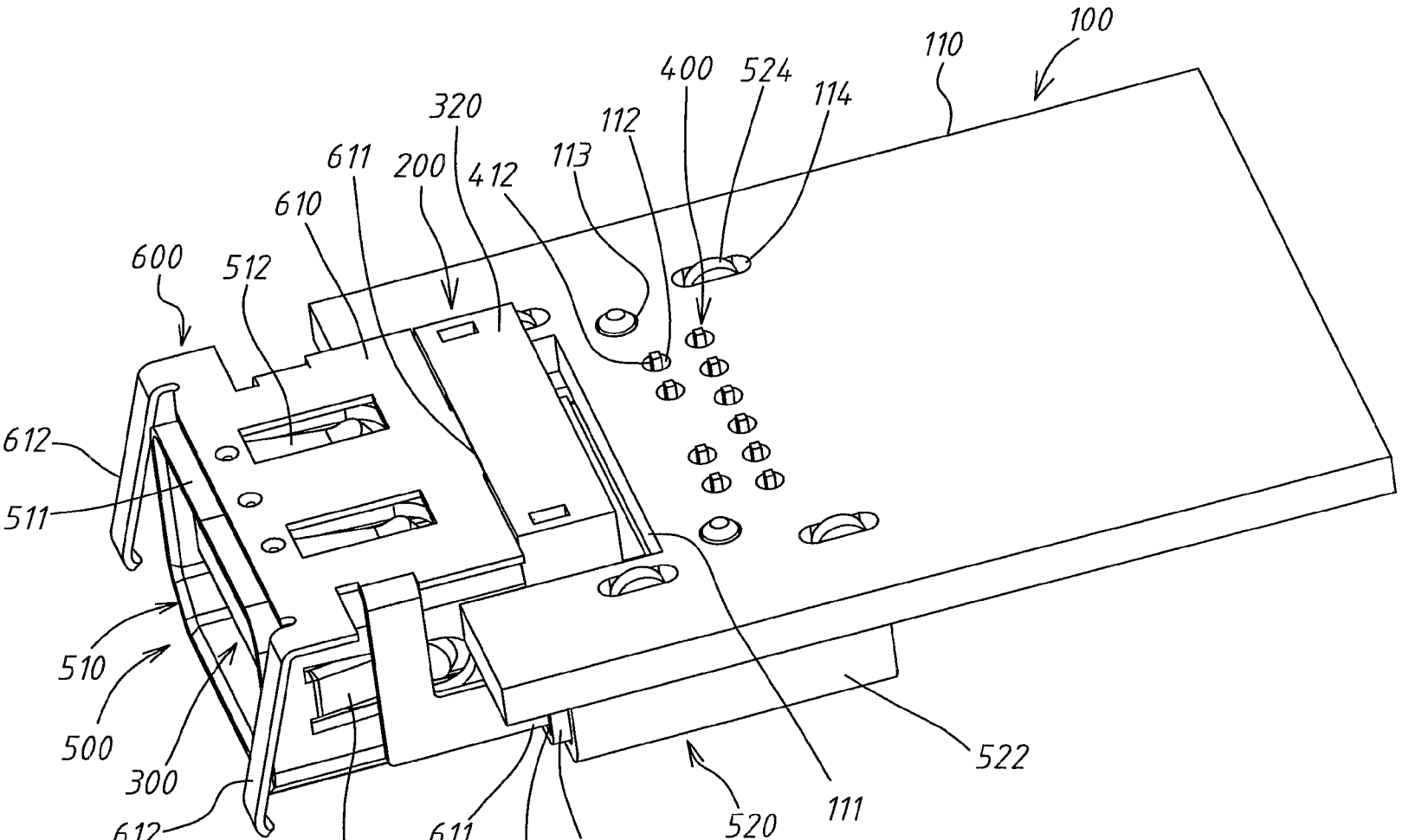
FIG. 1 is a schematic three-dimensional view showing the top surface of a mini display port structure according an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
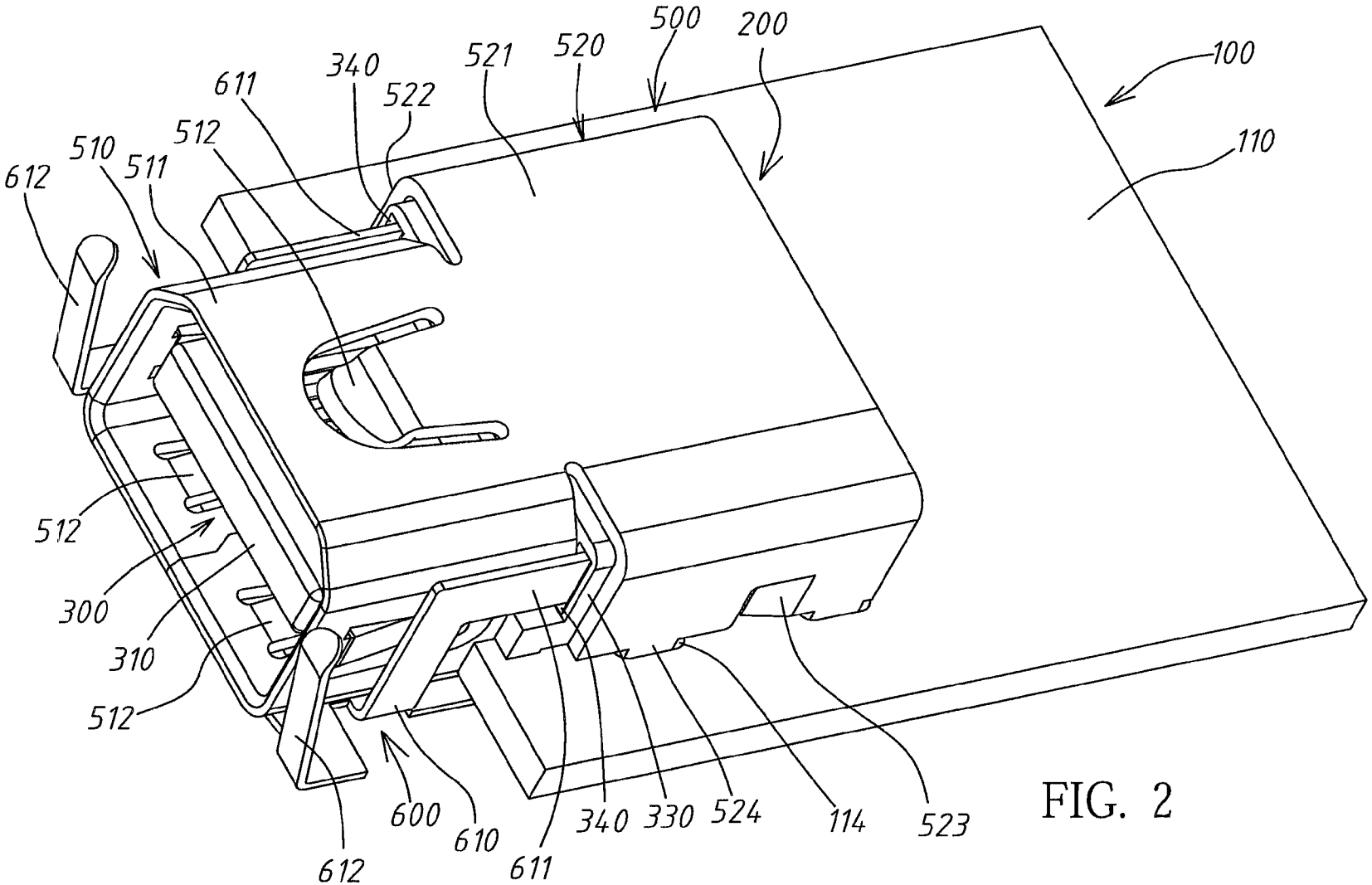
FIG. 2 is a schematic three-dimensional view showing the bottom surface of the mini display port structure according the embodiment of the present invention.
Figure 3:
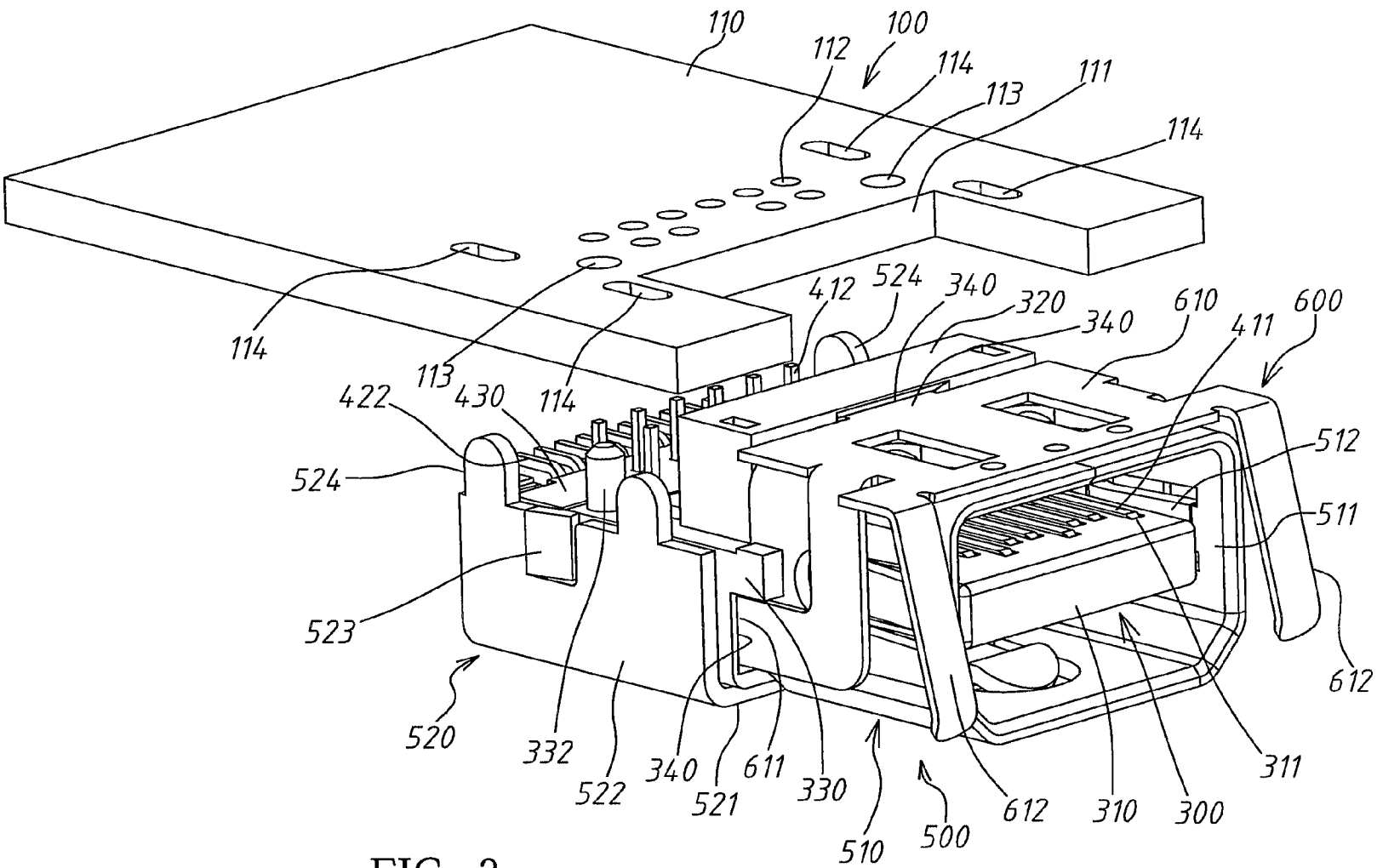
FIG. 3 is a schematic three-dimensional view showing a circuit board unit separated from a receptacle unit of the mini display port structure shown in FIG. 1.

Referring to FIG. 1 to FIG. 3, FIG. 1 and FIG. 2 are schematic three-dimensional views respectively showing the top and bottom surfaces of a mini display port structure according an embodiment of the present invention, and FIG. 3 is a schematic three-dimensional view showing a circuit board unit separated from a receptacle unit of the mini display port structure shown in FIG. 1. As shown in the figures, in one embodiment, a mini display port structure includes a circuit board unit 100 and a receptacle unit 200.

Figure 4:
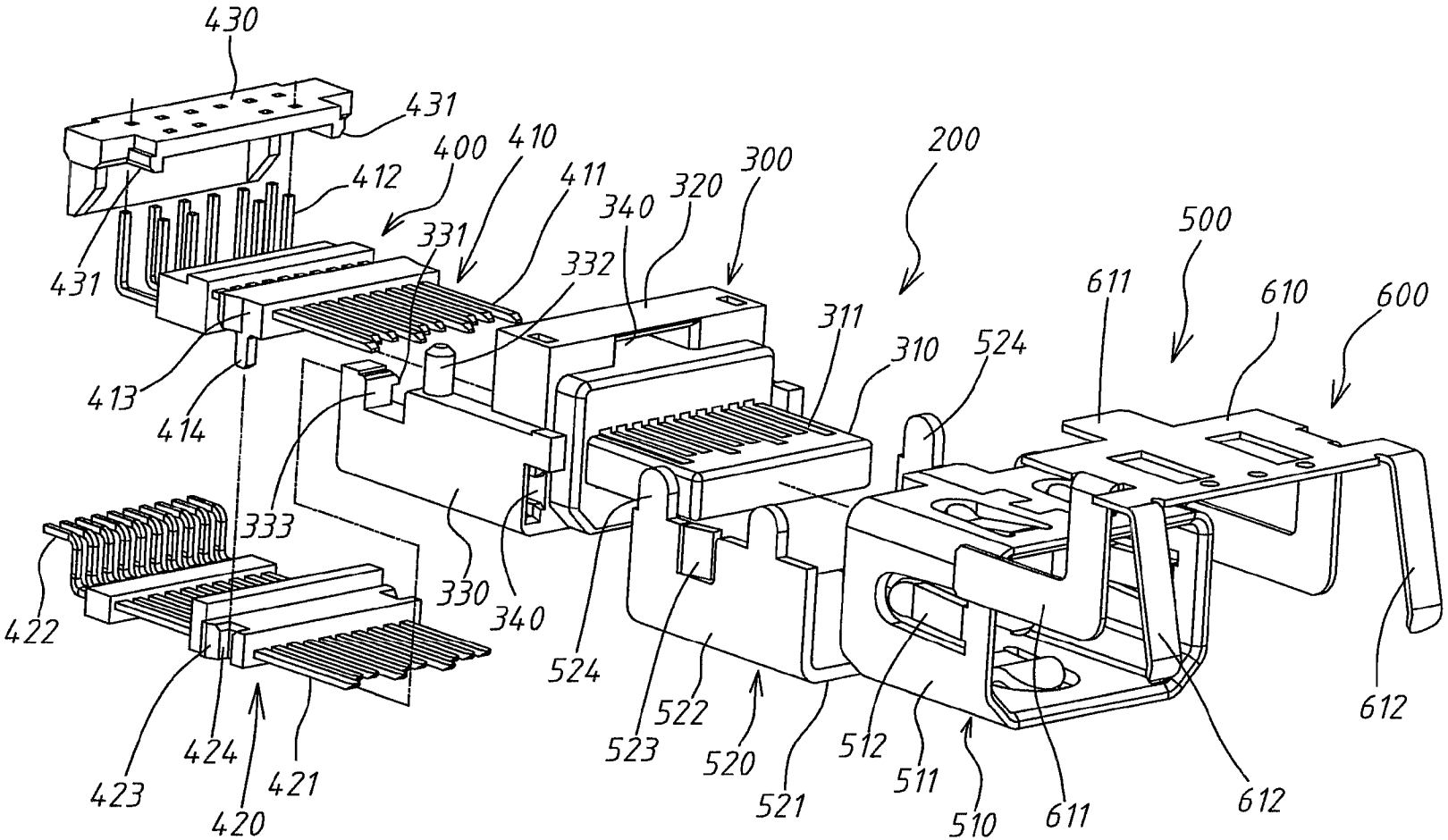
FIG. 4 is a schematic explosive view of the receptacle unit shown in FIG. 3.
Figure 5:
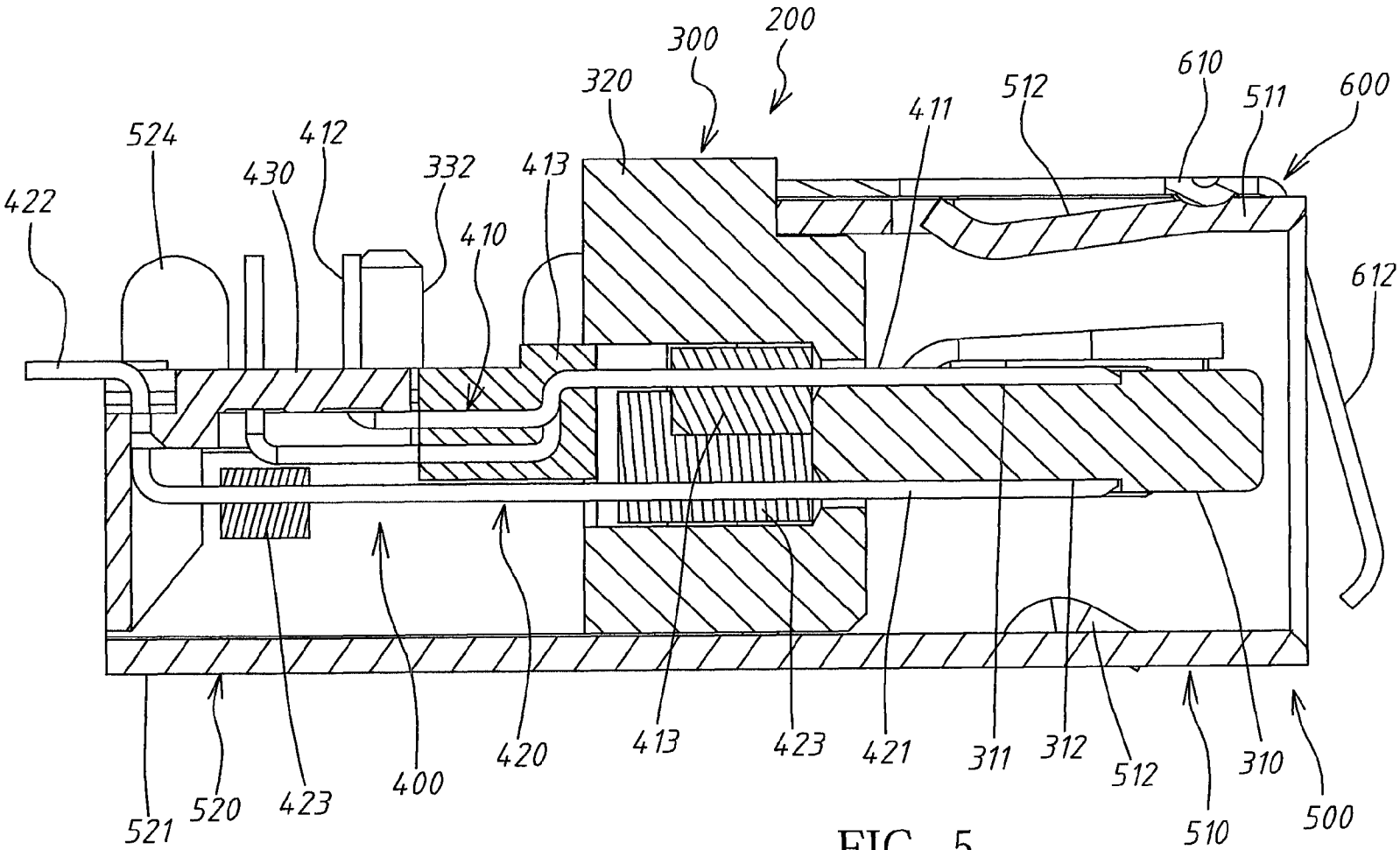
FIG. 5 is a schematic cross-sectional view of the receptacle unit shown in FIG. 3.

Referring to FIG. 4 to FIG. 5, FIG. 4 and FIG. 5 are schematic explosive and cross-sectional views of the receptacle unit 200 according to the embodiment of the present invention.

As shown in the figures, the circuit board unit 100 has a base board 110, wherein an opening 111 is formed on one side of the base board 110 for accommodating a portion of the receptacle unit 200 and placing the circuit board unit 110 at an elevation within the height of receptacle unit 200, i.e. the elevation of the circuit board unit 100 is overlapped with that of the receptacle unit 200, thereby using the height of the receptacle unit to include the height of the circuit board unit at the same time.

The receptacle unit 200 is connected to the base board 110 of the circuit board unit 100 with one portion of the receptacle unit 200 received in the opening 111 of the circuit board unit 100. In practice, the receptacle unit 200 includes a plastic holder 300, a terminal set 400 assembled inside the plastic holder 300, and an outer shell 500 which is assembled around the plastic holder and shields the plastic holder.

The plastic holder 300 is an insulator, and has a holder body 310. A plurality of first terminal slots 311 and a plurality of second terminal slots 312 are formed on a top surface and a bottom surface of the holder body 310 respectively. The terminal set 400 includes a first terminal block 410 and a second terminal block 420, wherein the first terminal block 410 has a plurality of first terminals 411 inserted into the first terminal slots 311 of the plastic holder 300, and the second terminal block has a plurality of second terminals 421 inserted into the second terminal slots 312 of the plastic holder 300.

Each of the first terminals 411 has an external end portion 412 protruding out of the plastic holder 300, and each of the second terminals 421 has an external end portion 422 protruding out of the plastic holder 300, wherein the external end portion 412 of each of the first terminals 411 is perpendicular to the base board 110, and a plurality of combination holes 112 are formed on respective positions of the base board 110 corresponding in number and position to the external end portions 412 of the first terminals 411, wherein the external end portions 412 are electrically combined with the combination holes 112 by using a DIP technology. The external end portions 422 of the second terminals 421 are parallel to the base board 110, and the external end portions 422 of the second terminals 421 are electrically combined with the base board 110 by using a SMT.

The first terminal block 410 is molded with two first retainers 413, and the first terminals 411 are inserted and retained at equal intervals in the first retainers 413. Similarly, the second terminal block 420 is molded with two second retainers 423, and the second terminals 421 are inserted and retained at equal intervals in the second retainers 423. In order to maintain the relative position between the first terminal block 410 and the second terminal block 420, a combing structure is disposed therebetween. In practice, a receiving groove 424 is disposed on each of both sides of the second retainer 423, and an inserting pillar 414 is disposed on each of both sides of the first retainer 413 corresponding to the receiving groove 424. The inserting pillar 414 is inserted into the receiving groove 424 for maintaining and stabilizing the distance and position between the first terminal block 410 and the second terminal block 420.

The terminal set 400 further includes a cover 430 which receives the external end portions 412 of the first terminals 411 and the external end portions 422 of the second terminals 421 for shielding the first terminals 411 and the second terminals 421.

The top surface and both sides of the holder body 310 of the plastic holder 300 have a top platform 320 and two sidewalls 330, wherein a clip 331 is formed on an inner edge of each of the sidewalls 330, and a hook 431 is disposed on each of both sides of the cover 430 corresponding to the clip 331, and the hook 431 is clipped with the clip 331 for combining and fastening the cover 430 the plastic holder 300.

Further, as to a structure for combining the plastic holder 300 and the base board 110 of the circuit board unit 100, in practice, a first positioning pillar 332 is disposed on top of each of the sidewalls 330 of the plastic holder 300, and a first positioning hole 113 is formed on the base board 110 corresponding in position to the first positioning pillar 332 of each of the sidewalls 330, and the first positioning pillar 332 is engaged with the first positioning hole 113 for combining and fastening the plastic holder 300 and the base board 110 of the circuit board unit 100.

The outer shell 500 is sheet metal piece, and includes a frame-type shell 510 and an extensive trough 520 connected to each other. The extensive trough 520 has a bottom plate 521 and two lateral walls 522 connected to both sides of the bottom plate 521. Each of the lateral walls 522 has a slanted protrusive plate 523, and each of the two sidewalls 330 of the plastic holder 300 has an engaging groove 333 corresponding in position to the slanted protrusive plate 523, and the two lateral walls 522 of the extensive trough 520 envelop the two sidewalls 330 of the plastic holder 300 with the slanted protrusive plate 523 engaged with the engaging groove 333, thereby assembling and fastening the outer shell 500 and the plastic holder 300.

A combining structure is also disposed between the outer shell 500 and the base board 110 of the circuit board unit 100. In practice, two second positioning pillars 524 are disposed on top of each of the lateral walls 522 of the outer shell 500 respectively, and two second positioning holes 114 corresponding in number and position to the second positioning pillars 524 are formed on the base board 110, and the second positioning pillars 524 are engaged with the second positioning holes 114 for combining and fastening the outer shell 500 and the circuit board unit 100.

There is a shell wall 511 surrounding the frame-type shell 510 of the outer shell 500, and at least one elastic clip 512 is disposed on the shell wall 511. When the connector insert (not shown) is inserted into the second positioning hole and is electrically connected to the terminal set 400, the elastic clip 512 may clamp the connector insert at the same time for providing the stability of the connector insert engaged with the frame-type shell 510.

Further, the mini display port structure further includes an elastic grounding member 600 contacting the frame-type shell 510 of the outer shell 500 for grounding use. In practice, the elastic grounding member 600 includes metal inverted-U-shaped plate 610 which envelops the shell wall 511 of the frame-type shell 510 of the outer shell 500, and a top surface and both side surfaces of the inverted-U-shaped plate 610 each has an inserting plate 611. An inserting groove 340 is formed between the holder body 310 and each of the top platform 320 and the two sidewalls 330 of plastic holder 300, and the elastic grounding member 600 is combined with the plastic holder 310 by inserting the inserting plate 611 into the inserting groove 340 and maintaining the contact with the frame-type shell 510.

Two elastic arms 612 are disposed on both sides of an end surface of is the inverted-U-shaped plate 610 opposite to the inserting plate 611 for providing an elastic contact when the connector insert is received.

According to the mini display port structure of the present invention, a partial height of the receptacle unit is contained in the opening of the circuit board unit, such that the circuit board unit is elevated at a certain position within the height of receptacle unit, and thus the height of the receptacle unit can include the height of the circuit board unit at the same time, thereby shrinking the height of the mini display port structure after the circuit board unit is assembled for making a compact mini displayport. In view of the foregoing, the object of the present invention can be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A mini display port structure for receiving a connector insert, the mini display port structure comprising:

a circuit board unit having a base board, wherein an opening is formed on one side of the base board; and a receptacle unit of which a portion is accommodated in the opening and is connected to the base board, wherein the receptacle unit comprises:

a plastic holder;

a terminal set assembled inside the plastic holder; and an outer shell assembled around the plastic holder and shielding the plastic holder, wherein the plastic holder has a holder body, and a plurality of first terminal slots and a plurality of second terminal slots are formed on a top surface and a bottom surface of the holder body respectively; the terminal set comprising a first terminal block and a second terminal block, the first terminal block having a plurality of first terminals inserted into the first terminal slots of the plastic holder, the second terminal block having a plurality of second terminals inserted into the second terminal slots of the plastic holder, wherein each of the first terminals and the second terminals has an external end portion protruding out of the plastic holder, and the external end portion of each of the first terminals is perpendicular to the base board, and a plurality of combination holes are formed on respective positions of the base board corresponding in number and position to the external end portions of the first terminals, and the external end portions of the second terminals are parallel to the base board, wherein the first terminal block is molded with at least one first retainer, and the first terminals are inserted and retained at equal intervals in the first retainer; and the second terminal block is molded with at least one second retainer, and the second terminals are inserted and retained at equal intervals in the second retainer, wherein a receiving groove is disposed on each of both sides of the second retainer, and an inserting pillar is disposed on each of both sides of the first retainer corresponding in position to the receiving groove, and the inserting pillar is inserted into the receiving groove, wherein the terminal set further comprises a cover which receives the external end portions of the first terminals and the external end portions of the second terminals, and shields the first terminals and the second terminals, wherein the top surface and both sides of the holder body of the plastic holder have a top platform and two sidewalls, and a clip is formed on an inner edge of each of the sidewalls, and a hook is disposed on each of both sides of the cover corresponding in position to the clip, and the hook is clipped with the clip.

2. The mini display port structure as claimed in claim 1, wherein a first positioning pillar is disposed on top of each of the sidewalls of the plastic holder, and a first positioning hole is formed on the base board corresponding in position to the first positioning pillar of each of the sidewalls, and the first positioning pillar is engaged with the first positioning hole.

3. The mini display port structure as claimed in claim 2, wherein the outer shell comprises a frame-type shell and an extensive trough connected to each other, the extensive trough having a bottom plate and two lateral walls connected to both sides of the bottom plate, each of the lateral walls having a slanted protrusive plate, each of the two sidewalls of the plastic holder having an engaging groove corresponding in position to the slanted protrusive plate, the two lateral walls of the extensive trough enveloping the two sidewalls of the plastic holder with the slanted protrusive plate engaged with the engaging groove.

4. The mini display port structure as claimed in claim 3, wherein at least one second positioning pillar is disposed on top of each of the lateral walls of the outer shell, and at least one second positioning hole corresponding in number and position to the second positioning pillar is formed on the base board, and the second positioning pillar is engaged with the second positioning hole.

5. The mini display port structure as claimed in claim 3, wherein there is a shell wall surrounding the frame-type shell of the outer shell, and at least one elastic clip is disposed on the shell wall.

6. The mini display port structure as claimed in claim 5, further comprising:

at least one elastic grounding member contacting the frame-type shell of the outer shell.

7. The mini display port structure as claimed in claim 6, wherein the elastic grounding member comprises an inverted-U-shaped plate, the inverted-U-shaped plate enveloping the shell wall of the frame-type shell of the outer shell, a top surface and both side surfaces of the inverted-U-shaped plate each having an inserting plate, and an inserting groove is formed between each of the top platform and the two sidewalls of plastic holder and the holder body, and the elastic grounding member is engaged with the plastic holder by inserting the inserting plate into the inserting groove.

8. The mini display port structure as claimed in claim 7, wherein at least one elastic arm is disposed on an end surface of the inverted-U-shaped plate opposite to the inserting plate.

* * * * *